US007526097B2

(12) United States Patent
Akino

(10) Patent No.: US 7,526,097 B2
(45) Date of Patent: Apr. 28, 2009

(54) CONDENSER MICROPHONE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 779 days.

(21) Appl. No.: 11/178,273

(22) Filed: Jul. 12, 2005

(65) Prior Publication Data

US 2006/0013426 A1 Jan. 19, 2006

(30) Foreign Application Priority Data

Jul. 14, 2004 (JP) ..... 2004-206776

(51) Int. Cl.
*H04R 25/00* (2006.01)

(52) U.S. Cl. ..... 381/361; 381/362; 381/363; 381/189

(58) Field of Classification Search ..... 381/113, 381/122, 174, 175, 189, 361, 362, 363, 365, 381/366, 355, 390; 439/620.21; 361/816
See application file for complete search history.

(56) References Cited

U.S. PATENT DOCUMENTS 2,579,162 A * 12/1951 Veneklasen ..... 381/174
6,643,380 B2 * 11/2003 Rodemer ..... 381/369
7,330,559 B2 * 2/2008 Akino ..... 381/363
2005/0254679 A1 * 11/2005 Akino ..... 381/390

* cited by examiner

*Primary Examiner*—Huyen D Le
(74) *Attorney, Agent, or Firm*—Manabu Kanesaka

(57) ABSTRACT

In a gooseneck condenser microphone in which a condenser microphone unit is supported via a support pipe including a flexible pipe, the shield in a flexible pipe part is enhanced. In the condenser microphone including the condenser microphone unit and an output module section provided with a circuit board for outputting audio signals in a shield case, the condenser microphone unit being supported on the output module section via the support pipe including the flexible pipe, and the condenser microphone unit being connected electrically to the circuit board via a microphone cable 40 having a shield covering line 43, which is inserted in the support pipe, at least in a part of the microphone cable 40, which part being installed in the flexible pipe 31, 32, the shield covering line 43 is exposed, and the part of the microphone cable 40, which part being installed in the flexible pipe 31, 32, is brought into contact with the flexible pipe 31, 32 at many points.

3 Claims, 2 Drawing Sheets

CONDENSER MICROPHONE

TECHNICAL FIELD

The present invention relates to a gooseneck condenser microphone in which a condenser microphone unit is supported via a support pipe including a flexible pipe. More particularly, it relates to a technique for preventing noise resulting from electromagnetic wave noise with a high frequency generated from, for example, a cellular phone.

BACKGROUND ART

As described, for example, in Japanese Patent Application Publication No. H11-341576, a gooseneck condenser microphone has been used favorably in a conference facility such as an international conference hall from the viewpoint of its simple appearance and easy adjustment of angle and height.

In the gooseneck condenser microphone, a condenser microphone unit and an output module section are formed separately. The condenser microphone unit is supported on the output module section via a support pipe including a flexible pipe partially or wholly, and the condenser microphone unit can be brought close to the mouth of a speaker by means of the flexibility of the flexible pipe.

Usually, the condenser microphone unit incorporates a field effect transistor (FET) serving as an impedance converter. The output module section has a circuit board for outputting audio signals arranged in a cylindrical shield case, and the condenser microphone unit is connected to the circuit board via a dedicated microphone cable inserted in the support pipe.

The microphone cable includes a power line for supplying power to the condenser microphone unit, a signal line for sending audio signals generated from the impedance converter to the output module section, and a shield covering line for electrostatically shielding and grounding the power line and signal line. As the microphone cable, a two-core shield covering line in which the outer peripheral surface of shield covering line is covered with an external sheath (skin) is used. The output module section is sometimes called a power module section because it supplies power to the condenser microphone unit.

The part of microphone cable is vulnerable to noise (electromagnetic waves) from the outside because audio signals are transmitted imbalancedly. Therefore, strong electromagnetic waves that are applied to the microphone cable intrude into the condenser microphone unit or the output module section, and are detected by a semiconductor device etc., by which noise is sometimes generated.

In particular, a cellular phone, which has come into wide use in recent years, generates considerably strong electromagnetic waves (for example, in the range of several centimeters to several tens centimeters, field intensity reaching several ten thousands of intensity of field generated in the city by commercial electric waves), so that measures against electromagnetic waves generated from cellular phones are a pressing need in the field of microphone.

The flexible pipe functions as a shield for the microphone cable but does not function perfectly. Specifically, the flexible pipe is manufactured by forming a coil spring for carrying a restoring force using a round wire rod such as a steel wire rod and by putting a triangular wire rod, which has a triangular cross section and is plastically deformed, in a clearance between the coil springs from over the coil spring. Therefore, the flexible pipe has an impedance, though being a low resistance value (for example, about 1Ω), in the contact portion between these wire rods.

The condenser microphone unit and the output module section each have a reliable shied case. However, when viewed as the whole of microphone, the part of flexible cable is shielded imperfectly. Therefore, a high-frequency current due to strong electromagnetic waves intrudes into the microphone via the flexible pipe, and resultantly noise is sometimes generated as described above.

SUMMARY OF THE INVENTION

Accordingly, an object of the present invention is to enhance the shield in a flexible pipe part in a gooseneck condenser microphone in which a condenser microphone unit is supported via a support pipe including a flexible pipe.

To achieve the above object, the present invention provides a condenser microphone including a condenser microphone unit and an output module section provided with a circuit board for outputting audio signals in a shield case, the condenser microphone unit being supported on the output module section via a support pipe including a flexible pipe, and the condenser microphone unit being connected electrically to the circuit board via a microphone cable having a shield covering line, which is inserted in the support pipe, wherein at least in a part of the microphone cable, which part being installed in the flexible pipe, the shield covering line is exposed.

The present invention also embraces a mode in which in the case where the support pipe includes a metal pipe in addition to the flexible pipe, the shield covering line is exposed over the total length of the microphone cable.

According to the present invention, since the shield covering line of the microphone cable is brought into contact with the inner surface of the flexible pipe at many points, the resistance value of the flexible pipe is extremely low. Therefore, the function for shielding electromagnetic waves is improved significantly, and hence the occurrence of noise can be restrained effectively.

DETAILED DESCRIPTION

An embodiment of the present invention will now be described with reference to FIGS. 1 to 3. The present invention is not limited to this embodiment.

Figure 1:
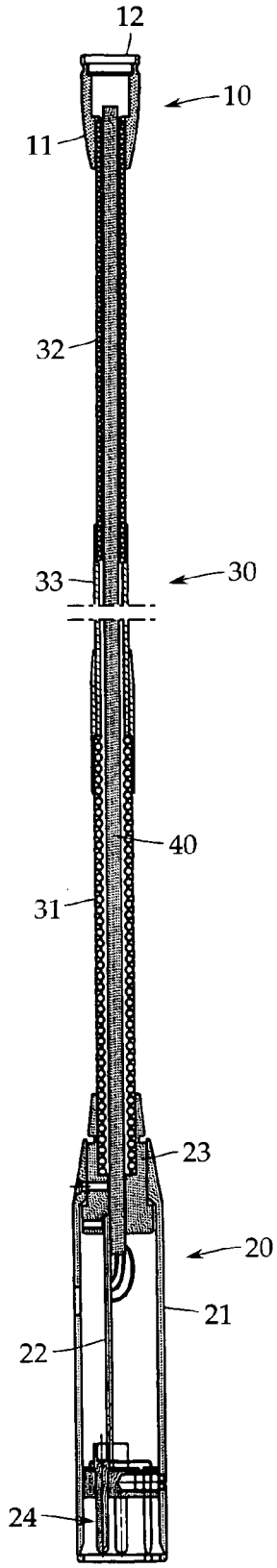
FIG. 1 is a sectional view showing one example of a condenser microphone in accordance with the present invention.
Figure 2:
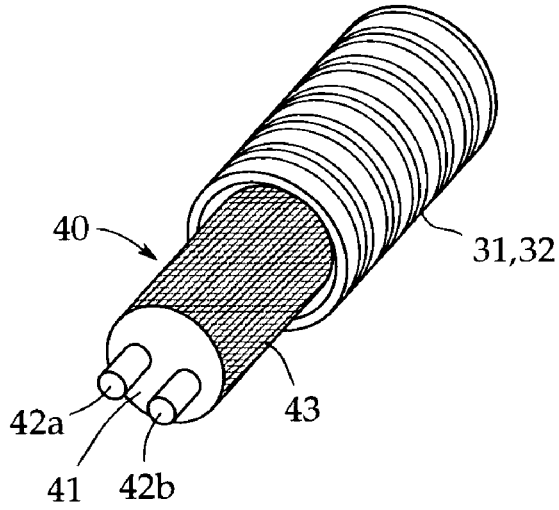
FIG. 2 is a perspective view showing a principal portion of the present invention.

FIG. 1 is a sectional view showing one example of a gooseneck condenser microphone in accordance with the present invention. This condenser microphone includes, as a basic configuration, a condenser microphone unit 10, an output module section (power module section) 20, and a support pipe 30 for supporting the condenser microphone unit 10.

The condenser microphone unit 10 has a cylindrical shield case 11 made of, for example, brass, and a microphone capsule 12 is mounted in the tip end portion of the shield case 11. Although not shown, the microphone capsule 12 incorporates a diaphragm and a backplate arranged in an opposed state. As a backplate material, electret may be used. Although not shown similarly, the shied case 11 contains a field effect transistor (FET) serving as an impedance converter electrically connected to the backplate.

The output module section 20 has a cylindrical shield case 21, which is also used as a support base. This shield case 21 is also formed of a conductive material such as brass. The shield case 21 contains a circuit board 22 having an audio output circuit, not shown, including a filter circuit, an amplifier circuit, and the like. The shield case 21 is installed on a table via a suitable fixing member.

On one end side (on the upper end side in this example) of the shield case 21, a mouthpiece 23 is provided to fixedly fitting the support pipe 30. On the other end side (on the lower end side in this example) of the shield case 21, an output connector 24 is mounted.

In the condenser microphone, as the output connector 24, an output connector of three-pin type which is specified in EIAJ RC-5236 "Audio latch lock round type connector" is generally used. The output connector 24 is connected to a phantom power source via a balanced shielded cable (both are not shown).

The support pipe 30 may use a flexible pipe over the total length thereof. In this example, however, the support pipe 30 is formed by two flexible pipes, namely, a proximal-side flexible pipe 31 and a distal-side flexible pipe 32 connected to each other by an intermediate metal pipe 33.

In this example, the proximal-side flexible pipe 31 has a larger diameter than the distal-side flexible pipe 32. This configuration is demanded in design. Each of the flexible pipes 31 and 32 is manufactured by forming a coil spring for carrying a restoring force using a round wire rod such as a steel wire rod and by putting a triangular wire rod, which has a triangular cross section and is plastically deformed, in a clearance between the coil springs from over the coil spring. Therefore, the flexible pipe 31, 32 can be deformed to an arbitrary position because the round wire rod and the triangular wire rod each have strong friction, and can self-hold the deformed state thereof.

In the support pipe 30, a microphone cable 40 is inserted to electrically connect the condenser microphone unit 10 to the output module section 20. A part of the microphone cable 40 is shown in FIG. 2. The microphone cable 40 is a two-core shield covering line, and includes a power line 42*a* and a signal line 42*b* inserted in an internal sheath 41 and a shield covering line 43 of, for example, a mesh form, which is wound on the entire of outer peripheral surface of the internal sheath 41.

For a cable having the shield covering line, not limited to the microphone cable, the shield covering line is usually covered with an external sheath (skin) over the total length thereof. In the present invention, in at least a portion of the microphone cable 40, which part being installed in the flexible pipes 31 and 32, the external sheath is removed, and the shield covering line 43 is exposed.

According to this configuration, the shield covering line 43 of the microphone cable 40 connects electrically with the inner surface of the flexible pipe 31, 32 at many points, and hence the resistance value of the flexible pipe 31, 32 decreases. Therefore, the shield in the part of the flexible pipe 31, 32 can be enhanced.

As an example, in the case where a flexible pipe with a length of 39 cm was prepared and an ordinary microphone cable having an external sheath over the total length of the flexible pipe was inserted into the flexible pipe, the direct current resistance value across both ends was 0.4Ω. By contrast, the microphone cable in accordance with the present invention, in which the external sheath was removed over the total length and the shield covering line was exposed, was inserted into the flexible pipe, and the direct current resistance value across both ends was measured. The measurement result was 0.01Ω or lower.

Figure 3:
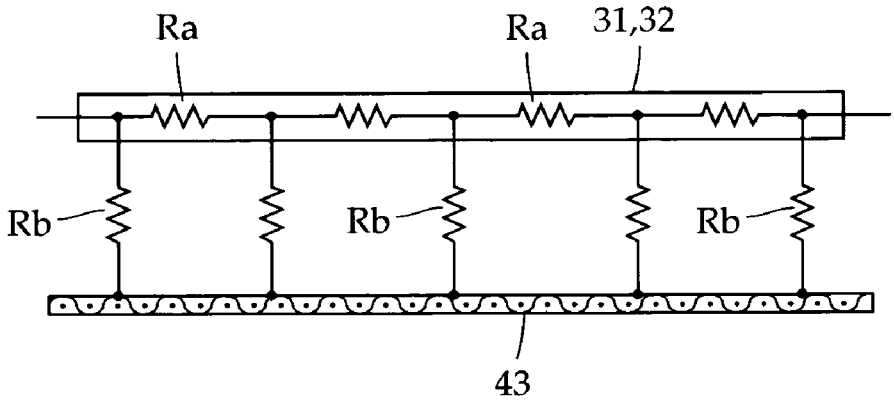
FIG. 3 is an equivalent circuit diagram in a connecting portion between a shield covering line and a flexible pipe in the present invention.

FIG. 3 shows an equivalent circuit of a connecting portion between the shield covering line 43 and the flexible pipe 31, 32. In FIG. 3, Ra denotes contact resistance mainly between wire rods that the flexible pipe has, and Rb denotes contact resistance with the shield covering line 43.

Thus, according to the present invention, a large number of short circuit like closed circuits due to the resistance Rb are formed between the shield covering line 43 and the flexible pipe 31, 32. Therefore, even if a high-frequency current flows in the flexible pipe 31, 32 due to strong electromagnetic waves, the high-frequency current is converted into thermal energy by the aforementioned short circuit like closed circuit and disappears. For this reason, the occurrence of noise due to electromagnetic waves is restrained.

In the case where the flexible pipes 31 and 32 and the metal pipe 33 coexist in the support pipe 30 as in the above-described example, the external sheath is removed over the total length of the support pipe 30, by which the shield covering line 43 may be exposed not only in the part in the flexible pipe but also in a part installed in the metal pipe 33.

The present application is based on, and claims priority from, Japanese Application Serial Number JP2004-206776, filed Jul. 14, 2004, the disclosure of which is hereby incorporated by reference herein in its entirety.

The invention claimed is:

1. A condenser microphone comprising:

a condenser microphone unit, an output module section having a circuit board for outputting audio signals obtained from the condenser microphone unit, a metal support pipe for supporting the condenser microphone unit on the output module section, and a microphone cable for electrically connecting the circuit board and the condenser microphone unit, inserted in the metal support pipe, said microphone cable having a shield covering line, wherein the shield covering line of the microphone cable located in the metal support pipe is entirely exposed to the metal support pipe and directly contacts the metal support pipe at a plurality of points to reduce resistance value of the metal support pipe, thereby enhancing shield of the metal support pipe.

2. The condenser microphone according to claim 1, wherein the metal support pipe includes flexible pipes and a metal pipe interposed between the flexible pipes, and the shield covering line is exposed over an entire length of the microphone cable in the metal support pipe.

3. The condenser microphone according to claim 1, wherein said microphone cable includes a power line and a signal line located in an internal sheath, said shield covering entirely covering the internal sheath while being exposed outwardly.

* * * * *